US006141962A

United States Patent [19]

Stören et al.

[11] Patent Number: 6,141,962

[45] Date of Patent: Nov. 7, 2000

[54] CONTAINER FOR HIGH PRESSURE

[76] Inventors: Sigurd Stören, Stallmestervn, 6B, N-7046 Trondheim; Kaare Gether, Bakkey, 12, N-3290 Stavern; Björnar Bakken, Övre Movei 17, N-1450 Nesoddtangen, all of Norway

[21] Appl. No.: 09/214,799

[22] PCT Filed: Mar. 3, 1997

[86] PCT No.: PCT/NO97/00061

§ 371 Date: May 26, 1999

§ 102(e) Date: May 26, 1999

[87] PCT Pub. No.: WO98/02655

PCT Pub. Date: Jan. 22, 1998

[30] Foreign Application Priority Data

Jul. 10, 1996 [NO] Norway ..... 962895

[51] Int. Cl.[7] ..... F01B 29/10

[52] U.S. Cl. ..... 60/520; 60/524

[58] Field of Search ..... 60/517, 520, 524

[56] References Cited

U.S. PATENT DOCUMENTS

| | | | |
|---|---|---|---|
| 4,036,018 | 7/1977 | Beale | 60/520 |
| 4,596,160 | 6/1986 | Andersen et al. | 74/40 |
| 4,613,299 | 9/1986 | Backheim | 60/517 X |
| 4,638,633 | 1/1987 | Otters | 60/518 |
| 4,751,819 | 6/1988 | Eder | 60/517 |
| 5,074,114 | 12/1991 | Meijer et al. | 60/517 |
| 5,355,679 | 10/1994 | Pierce | 60/517 X |
| 5,743,091 | 4/1998 | Penswick et al. | 60/517 |

FOREIGN PATENT DOCUMENTS

| | | |
|---|---|---|
| 1-121553 | 5/1989 | Japan . |
| 1-125545 | 5/1989 | Japan . |
| WO 87/05986 | 10/1987 | WIPO . |

*Primary Examiner*—Hoang Nguyen

*Attorney, Agent, or Firm*—Crompton, Seager & Tufte, LLC

[57] ABSTRACT

A container for high pressure gases and fluids is provided with a tubular housing having a lid fastened to one or more axially extending elements within the housing for transferring axial forces from one end of the container to the other without subjecting the housing itself to axial forces.

9 Claims, 1 Drawing Sheet

CONTAINER FOR HIGH PRESSURE

Figure 1:
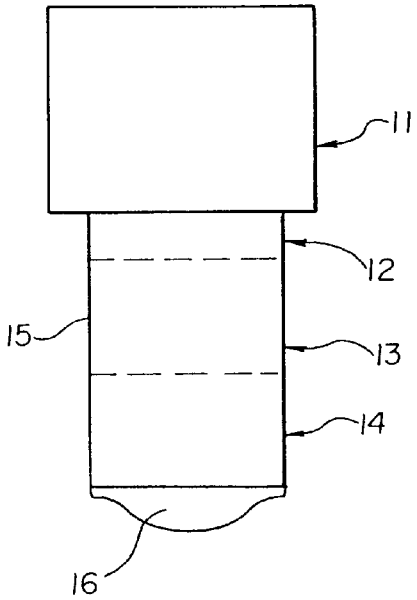

The invention relates to an improvement on a high pressure container, particularly for use as a transmission and generator housing for a Stirling motor as used in motor vehicles.

BACKGROUND

Various mechanical devices are designed to work under high pressure in a container. Normally, the safety requirements to reduce hazards are high, and consequently such containers have been made with thick walls. A reason for this may be the difficulty in estimating the load on such containers, with a combination of axial and tangential forces. Prior art containers which incorporate mechanical structures have therefore been heavy and expensive.

It is proposed to manufacture Stirling motors with a transmission housing incorporating one or more electrical generators which can also accommodate a gas volume and serve as a pressure accumulator for creating a counter pressure against the piston of the Stirling motor. Thus, the introduction of a shaft through the wall of the housing is not necessary.

U.S. Pat. No. 4,683,633 (Otters) discloses the use of a shell structure of metal sheets which are reinforced by windings of glass or carbon fibres. This structure is labour intensive at the manufacturing stage and does not remove the uncertainty of sizing, providing a container with a larger weight than acceptable, e.g. for use in a car. Stirling motors powering vehicles primarily are used in a hybrid connection with batteries and so heavy weight will be a particular disadvantage.

It has not been possible to replace steel with cast aluminium to reduce the weight, due to the unallowable concentration of stress at the transition between the cylinder of the Sterling motor and the transmission and generator casing.

OBJECT

The main object of the invention is to reduce the weight of containers in which mechanical equipment should operate under high and changing pressure relative to the environment. It is a further object to increase the safety of such structures by having better access to and better control over the tensions, and thus the margins for sizing.

It is a particular object to provide a container which in relation to weight and safety is particularly suited for use in cars, particularly domestic autombiles. It is a particular object to provide a transmission and generator housing for Stirling motors to be used in cars, which can be manufactured of a non-steel material and preferably of materials with a low density main substance.

It also is an object to provide a transmission and generator housing which allows an increase of the net volume, including gas volume, and/or of the gas pressure, without any increase in weight.

It is a requirement, that the transmission and generator housing should stand an inner pressure of at least approximately 8 MPa and that this pressure can be maintained without leakage in an extended period of use, regardless of being operated or not.

It is a requirement, that a material breakage not shall involve an explosion of the housing, but a controlled decompression ("leak-before-break").

These objects include the purpose of providing a transmission and generator housing for a Stirling motor, which can be manufactured with acceptable material and handling costs and wherein the tolerances at joining and/or maintenance are not critical.

The invention

The invention is stated generally in claim 1, while claims 2–8 specifies particular advantageous embodiments.

This container can be manufactured of anisotropic materials which have their strength properties adapted to the particular direction of load. Such a transmission and generator housing can be manufactured with a light composite material as the main component. This may be polyester with carbon fibre reinforcement. For journalling the crank shaft, with force transmission to the cylinder housing and journalling the generator, aluminium elements, which are also lighter than steel, can be used.

More details and effects of the invention will appear from the example below.

EXAMPLE

The invention is illustrated in the drawings, in which

Figure 2:
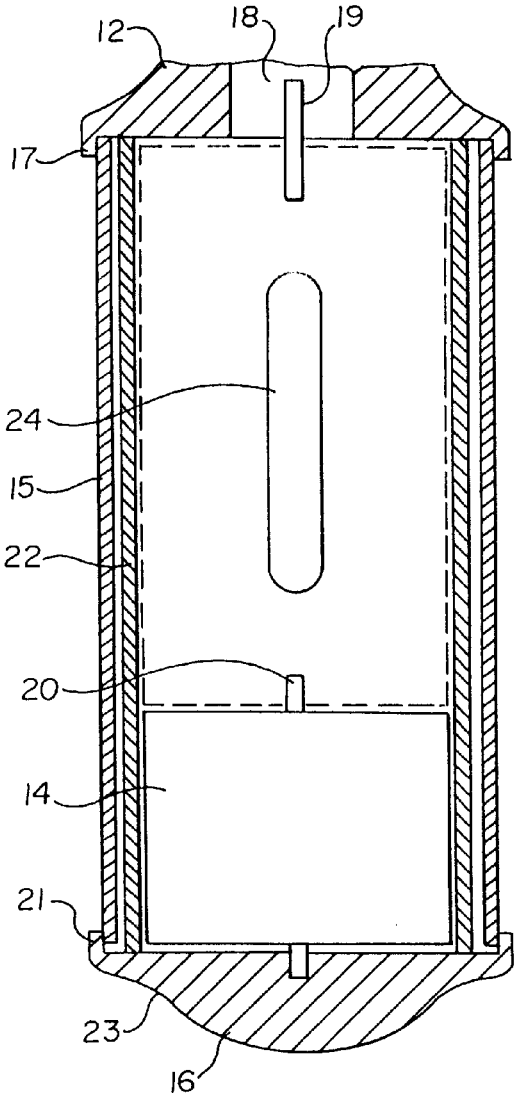
Figure 3:
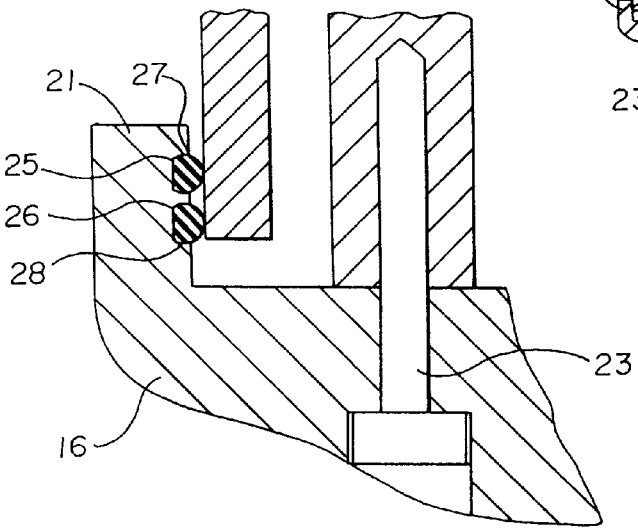

FIG. 1 is a schematical side view of a Stirling motor according to the invention, FIG. 2 is an axial section of a pressure container in the form of a transmission and generator housing for the Stirling-motor of FIG. 1, FIG. 3 is a radial section through the joint between the transmission and generator housing and the lid of FIG. 2, with some dimensions exaggerated to illustrate various mechanisms.

In FIG. 1 a Stirling motor is shown schematically, with a burner section 11, a pressure head 12, a crank structure providing the motor transmission 13 and an electrical generator 14. The working principle of the Stirling motor is considered known and shall not be described. A pressure chamber, the crank structure 13 and the generator 14, which may be of prior art, are accommodated in a receptacle in the form of a tubular housing 15 extending to the pressure head 12 and being closed with a lid 16 at the free end . The structure of the tubular housing 15 with the lid 16 is described in more detail below.

In FIG. 2 the tubular housing 15 is shown with an axial section together with the lower part of the pressure head 12. The pressure head 12 is provided with an annular, axially protruding flange 17 restricting recess for the tubular housing 15. The pressure head 12 has a central opening 18 for a piston rod 19. The piston rod 19 is connected with transmission parts (not illustrated), e.g. a crank shaft connected to an angular drive transferring the torque to an outlet shaft 20 connected to the electrical generator 14 at the end of the tubular housing 15.

The tubular housing 15 is closed with a lid 16. Corresponding to the pressure head 12, the lid 16 is provided with an annular flange 21 facing the tubular housing 15, concentrically thereto. Details of the annular flange 21 are shown in FIG. 3.

Concentrically to the tubular housing 15, a tension and carrying cylinder 22 is arranged. The tension and carrying cylinder 22 abuts an annular face of the pressure head 12 and at the other end a corresponding annular face abuts the lid 16. Both ends are fastened with four or more axial bolts 23 which can withstand the thrust acting against the pressure head and the lid. The cylinder 22 thus will have a tension. It may be manufactured of aluminum.

The tension and carrying cylinder 22 also serves as a carrier for the transmission elements, i.e. the crank shaft and angular drive (not illustrated), and additionally encloses the electrical generator 14. To ensure pressure balance, the cylinder 22 is provided with a longitudinal slot 24. This means that cylinder 22 is in radial equilibrium, transferring all the radial pressure to the outer tubular housing 15. The tension and carrying cylinder 22 is subject only to axial tension from the bolts 23 and additional forces from the crankshaft.

The invention will ensure the division of the strain in a radial force creating tangential tension in the tubular housing 15 and an axial force creating axial tension in the inner tension and carrier cylinder 22. This division of forces allows a reduciton of forces acting on the different parts and thereby a reduction of the dimensions relative to previous containers.

In an alternative embodiment, one or more axial tension columns, which are prestressed to exert an axial force on the cylinder 22, is/are used. This will reduce the risk of fatigue at changing load.

The tubular housing 15 may be manufactured of light metal or a composite material, e.g. polyester reinforced with carbon fibres, with relatively thin walls.

In FIG. 3 a section through the edge of the lid 16 with the flange 21 is shown. On the inner side of the flange 21 are located two annular grooves 25, 26 with a sealing ring 27, 28 in each, engaging the outer wall of the tubular housing 15 tightly. The sealing rings can be of rubber or neoprene with a circular section as shown, or be profiled. The figure shows a distance between the outer side of the tubular housing 15 and the inner side of the flange corresponding to an unloaded state. This implies that a certain radial expansion of the tubular housing 15 is allowed before engaging the flange 21. Further a certain bevelling of the lid and thus an inclined position of the flange 21 is allowed without transfering the tension from the sealing rings to the container parts. On radial tension and hence expansion to the tubular housing, the seal will improve and provide tightness.

Alternatively to the tension and carrier cylinder 22, there may be one or more axially extending bolts, e.g. in the form of rails or other rod shaped elements adapted for carrying the transmission elements and other equipment to be enclosed in the container. Such bolts can be arranged to create the lowest possible tension in the lid.

The container can also be utilized for purposes in which it periodically or permanently has no need for solid matter in the container, except for accomodating gases or fluids under pressure.

It is important that the tubular housing 15 as well as the sealing rings 27, 28 are of a material not allowing gas diffusion. To reduce the diffusion, the tubular housing 15 may be covered on the inside with a diffusion tight foil or coating.

The lid 16 should be designed to withstand axial forces and provide engagement for the bolts 23. It may be constructed of aluminium. To save weight, it may be constructed with an outer shell and an edge rib and four internal radial ribs from a centrally located journalling bushing, carrying a bearing for the generator.

The invention allows the use of light material in the bolts, the lid and the transmission flange, as well as a thin outer cylinder of a light material, with sufficient safety for breakage. The container will be simple and compact cylinder, with a substantial reduction of weight compared to exisiting containers. in a prior art embodiment, the transmission and generator housing for a 3 kW machine had a weight of 34 kg. By using the invention, the container for a 8 kW machine has a weight of 16 kg. Relative to the energy (kg/kW), this means a weight reduction to about ⅕.

What is claimed is:

1. In a high pressure container provided for accommodation of a working mechanical device being exposed to changing forces, comprising a shell which is sized to withstand the internal pressure of the container, the improvement which comprises:

a tubular housing;

a lid adapted for closing at least one end of said housing; and one or more axially extending, tension loaded elements within said tubular housing, fastened to said lid for transferring axial forces developed within said housing to a corresponding lid element at the other end of the tubular housing, enabling the tubular housing to take only radial loads, while the axially extending elements transfer any axial load created by the internal pressure on the lid to the corresponding lid element at the other end of said housing.

2. A container according to claim 1, wherein the tubular housing is covered on the inner side with a coating or foil sheet of low gas permeability.

3. A container according to claim 1 wherein said one or more axially extending elements includes a cylindrical element having a wall provided with an opening to provide pressure balance on opposite sides of the wall.

4. A container according to claim 1, wherein the surface of the lid opposite to the tubular housing is provided with an outer annular flange engaging the outside of the tubular housing with no transfer of axial forces to the tubular housing.

5. A container according to claim 4, wherein the annular flange is provided with one or more inner annular grooves for accommodating a sealing gasket.

6. A container according to claim 1, wherein the lid is fastened to the axially extending element with axial screws.

7. A container according to claim 3, wherein said one or more axially extending elements are prestressed to exert an axial force on said cylindrical element.

8. A container according to claim 1, wherein the tubular housing and the axially extending elements are adapted to move axially relatively to one another.

9. A container according to claim 1 wherein said one or more axially extending tension loaded elements constitute carrying elements for a crank shaft and adjoining parts of a Stirling motor.

* * * * *